US011786782B2

(12) United States Patent
Cooley et al.

(10) Patent No.: US 11,786,782 B2
(45) Date of Patent: Oct. 17, 2023

(54) EXERCISE APPARATUS FOR STRENGTHENING THE HIPS AND ASSOCIATED MUSCULATURE

(71) Applicants: Gerald Earl Cooley, Clover, SC (US); Quresh Sachee, Charlotte, NC (US); John David Bumgarner, Maiden, NC (US)

(72) Inventors: Gerald Earl Cooley, Clover, SC (US); Quresh Sachee, Charlotte, NC (US); John David Bumgarner, Maiden, NC (US)

(73) Assignee: Hipstr LLC, Charlotte, NC (US)

( * ) Notice: Subject to any disclaimer, the term of this patent is extended or adjusted under 35 U.S.C. 154(b) by 0 days.

(21) Appl. No.: 16/717,181

(22) Filed: Dec. 17, 2019

(65) Prior Publication Data

US 2021/0178224 A1 Jun. 17, 2021

(51) Int. Cl.
*A63B 23/04* (2006.01)
*A63B 21/04* (2006.01)
(Continued)

(52) U.S. Cl.
CPC ..... *A63B 23/0482* (2013.01); *A63B 21/0442* (2013.01); *A63B 21/0557* (2013.01);
(Continued)

(58) Field of Classification Search
CPC ..... A63B 23/0211; A63B 23/0405; A63B 23/0482; A63B 21/065; A63B 21/4001; A63B 21/4009; A63B 21/02; A63B 21/04; A63B 21/0407; A63B 21/0421; A63B 21/0435; A63B 21/045; A63B 21/055; A63B 21/0552; A63B 21/0555; A63B 21/0557; A63B 21/16; A63B 21/1609; A63B 21/1618; A63B 21/1627; A63B 21/1636; A63B 21/1645; A63B 21/1654; A63B 21/1663; A63B 2102/32; A63B 69/3608; A63B 2225/093
See application file for complete search history.

(56) References Cited

U.S. PATENT DOCUMENTS 3,215,438 A 11/1965 Sheldon et al.
3,698,721 A 10/1972 Stewart
(Continued)

OTHER PUBLICATIONS

International Search Report and the Written Opinion of the International Searching Authority for related International Application No. PCT/US2020/063956, dated Jan. 29, 2021, 12 pages. (All art cited herein was cited via IDS dated Feb. 12, 2021.

*Primary Examiner* — Sundhara M Ganesan
*Assistant Examiner* — Zachary T Moore
(74) *Attorney, Agent, or Firm* — Shumaker, Loop & Kendrick, LLP; Lloyd J. Wilson

(57) ABSTRACT

An exercise apparatus for strengthening the hips that includes a belt adapted for being tightly secured around the hip area of a user and a resistance band attached to the belt at a position wherein the resistance band resides proximate the hips. An anchor is provided for attaching a distal end of the resistance band to a support generally at a level with the hips whereby rotating the hips applies resistance to the hips providing strengthening resistance to the hips. A method of using the apparatus is disclosed.

4 Claims, 7 Drawing Sheets

(51) Int. Cl.

| | |
|---|---|
| ***A63B 21/055*** | (2006.01) |
| ***A63B 21/00*** | (2006.01) |
| ***A63B 21/16*** | (2006.01) |
| ***A63B 102/32*** | (2015.01) |
| ***A63B 69/36*** | (2006.01) |

(52) U.S. Cl.
CPC ..... *A63B 21/1663* (2013.01); *A63B 21/4009* (2015.10); *A63B 69/3608* (2013.01); *A63B 2102/32* (2015.10)

(56) References Cited

U.S. PATENT DOCUMENTS

| | | | | | |
|---|---|---|---|---|---|
| 5,188,366 | A | | 2/1993 | Dorotinsky et al. | |
| 5,209,482 | A | * | 5/1993 | Hopfer ..... | A63B 69/0059 482/904 |
| 5,984,796 | A | | 11/1999 | Mah | |
| 6,120,418 | A | * | 9/2000 | Plough ..... | A63B 21/4009 482/121 |
| 6,786,855 | B2 | | 9/2004 | Prichard | |
| 7,874,970 | B2 | * | 1/2011 | Glisan ..... | A63B 21/4007 482/124 |
| 9,011,156 | B2 | * | 4/2015 | Hallmark ..... | A63B 21/4025 434/247 |
| 2006/0084556 | A1 | * | 4/2006 | Payne ..... | A63B 21/0552 482/904 |
| 2014/0200499 | A1 | * | 7/2014 | Champion ..... | A63B 21/4009 602/36 |
| 2015/0360076 | A1 | * | 12/2015 | Celebrini ..... | A63B 21/0442 482/121 |

* cited by examiner

EXERCISE APPARATUS FOR STRENGTHENING THE HIPS AND ASSOCIATED MUSCULATURE

TECHNICAL FIELD AND BACKGROUND OF THE INVENTION

This application discloses an exercise apparatus for strengthening the hips. The invention has application in both the sports and health fields. For purposes of the disclosure of the invention in this application, the descriptions will be oriented towards the sports field, and particularly golf, but other activities such as baseball and tennis will also benefit. Golf is a sport in which the level of exertion and articulation of various body parts varies between extremes. When teeing off, and particularly when using a driver or other long-distance club, there is a direct correlation between the speed at which the clubhead strikes the ball and the distance the ball travels. All else being equal, the further a ball travels off of the tee, the better.

Clubhead speed is a function of two simultaneous motions. In the first motion, the club is swung by the player by gripping the club with the hands and taking the club back using the arms, "the backswing" or "takeaway", and then swinging the club forward, the "downswing", with the arms on an arc designed to place the center of the clubface squarely on the ball at impact. However, if the golfer stands still with the legs, hip and torso relatively motionless and swings only with the arms, the ball will travel only a relatively short distance. This may be a highly desirable technique for putting, chipping and pitching where finesse, feel and precision are more important than distance. However, this first motion is not calculated to maximize the distance the ball travels when struck.

So, a skilled golfer will strike the ball with a combination of body movements calculated to maximize the speed of the clubhead at impact with the ball. The second body movement involves use of the legs, hips and torso. In general, the hips act as a torsion spring and rotate to allow the upper body, particularly the shoulders, to assume during the backswing an approximate right angle to the direction of desired ball travel, while the legs flex and bend to some degree but remain generally aligned with the direction of desired ball travel.

Meanwhile, the arms have rotated rearwardly and upwardly so that at the top of the backswing the hands and the grip of the club are positioned well above the trailing shoulder. At the top of the backswing, the golfer reverses the direction of rotation in a controlled, accelerating manner, causing the body from the shoulders down through the hips to rotate back through the original address position and then continue further rotation until the shoulders have rotated perhaps as much as 180 degrees or more from the top of the backswing position.

At the same time as the body is rotating from the top of the backswing the arms are also moving downwardly so that the clubhead travels through the ball position and continues on to the "follow through." The speed of the clubhead is the aggregate of the speed of the arm motion and the hip/torso motion, and the more rapidly both of these motions simultaneously occur the more potential energy is available to be transferred to the ball by the clubhead.

To maximize the potential for a clubhead speed that includes a rapid hip rotation, exercise directed towards strengthening the hips and associated musculature is desirable. The most desirable exercise is exercise that not only strengthens the musculature but at the same time trains the muscles to expect resistance when being asked to do work. Within the golf swing context, if the muscle expects for there to be substantially more resistance than actually occurs, the muscle will naturally exert more force, increasing torso rotation speed which is added to the arm swing speed to result in an increased club head speed when the ball is struck.

Golf instructors refer to the proper sequence of body motions as the "kinematic sequence." The proper sequence, as demonstrated by professional golfers and skilled amateurs, begins from the ground up: pelvis/hips, followed by thorax, arms, hands, and finally clubhead. Typically, unskilled amateur golfers reverse this sequence.

In this application the term "hip musculature" is used to mean the Gluteus Medius, Abdominal External Oblique, Adductur longus, Brevus and Magnus, Rectus Abdominis and Tensor Fasciae Latae muscles, although other muscles will be affected, as well.

SUMMARY OF THE INVENTION

Therefore, it is an object of the invention to provide an exercise and training apparatus that allows a user to strengthen the hips and associated musculature.

It is another object of the invention to provide an exercise and training apparatus that allows the user to train the hips to expect resistance to hip rotation during a golf swing.

It is another object of this invention to aid in the development of a golf swing that emulates a proper kinematic sequence from the ground up.

It is another object of the invention to provide an exercise and training apparatus that allows the user to train indoors or outdoors.

It is another object of the invention to provide an exercise and training apparatus that allows the user to exercise and train the hips in both directions of rotation.

It is another object of the invention to provide an exercise and training apparatus that allows a left hand and a right hand person to use the same device in the same manner.

It is another object of the invention to strengthen the hips and lower body for sports involving rotational movement of the body such as hitting, swinging, and kicking, for example, activities such as golf, baseball, football, tennis, soccer and boxing.

These and other objects and advantages are achieved by providing an exercise apparatus for strengthening the hips and including a belt adapted for being tightly secured around the hip area of a user, a resistance band attached to the belt at a position wherein the resistance band resides proximate the hips, and an anchor for attaching a distal end of the resistance band to a support generally at a level with the hips with anchoring point at level of iliac crest. Rotating the hips applies resistance to the hips providing strengthening to the hips.

According to another aspect of the invention, the belt is constructed of fabric webbing and includes complementary touch fasteners, especially hook and loop attached to the belt for securing the belt to the user.

According to another aspect of the invention, at least one attachment device is provided for attaching the resistance band to the belt.

According to another aspect of the invention, the resistance band comprises an elastic band.

According to another aspect of the invention, a securing strap is attached by a proximal end to a distal end of the resistance tubing for being trapped between a door and door frame for use, the anchor being attached to a distal end of the securing strap.

According to another aspect of the invention, the belt includes a length of hook material extending beyond one end of the webbing, and an opposite end of the belt includes at least one ring for receiving the length of hook material and securing the belt around the hips of the user.

According to another aspect of the invention, at least one ring is attached to the belt and is adapted for receiving and being attached to a proximal end of the resistant band.

According to another aspect of the invention, first and second rings are attached to the belt at spaced apart positions and are adapted for receiving and being attached to a proximal end of the resistant band.

According to another aspect of the invention, a single ring is attached to the belt in a central position on the belt and is adapted for receiving and being attached to a proximal end of the resistant band for use in both a first and a second direction of rotation of the user.

According to another aspect of the invention, a single ring is attached to the belt and is adapted for receiving and being attached to a proximal end of the resistant band.

According to another aspect of the invention, a high-friction layer is applied to an inner surface of the belt.

According to another aspect of the invention, an exercise apparatus for strengthening the hips is provided, and includes a belt constructed of webbing and touch fasteners carried by the webbing adapted for tightly securing the belt around the hip area of a user. At least one attachment ring is secured to the belt and an elastic resistance band is adapted for being attached to the attachment ring of the belt at a position wherein the resistance band resides proximate the hips. An anchor is provided having a width sufficient for attaching a distal end of the resistance band to a support generally at a level with the hips.

According to another aspect of the invention, a wear-resistant strap is attached to a distal end of the resistance band and the anchor for resisting wear from being trapped between two surfaces of a support.

According to another aspect of the invention, an exercise apparatus for strengthening the hips is provided and includes a belt constructed of webbing having a high-friction layer applied to an inner surface of the belt. Touch fasteners, such as hook and loop, are carried by the webbing and adapted for tightly securing the belt around the hip area of a user and at least one attachment ring is secured to the belt. An elastic resistance band is provided and is adapted for being attached to the attachment ring of the belt at a position wherein the resistance band resides proximate the hips. An anchor is provided having a width sufficient for attaching a distal end of the resistance band to a support generally at a level with the hips. A wear-resistant strap is attached to a distal end of the resistance band and the anchor for resisting wear from being trapped between two surfaces of a support.

According to another aspect of the invention, a method of strengthening the hips is disclosed that includes the steps of providing a belt adapted for being tightly secured around the hip area of a user, a resistance band having a first predetermined level of resistance and adapted to be attached to the belt at a position wherein the resistance band resides proximate the hip area of the user, and an anchor for attaching a distal end of the resistance band to a support generally at a level with the hips. The belt is secured around a user's hips and the anchor is attached to a support. The belt is moved to a position placing the resistance band under tension. The hips are rotated repeatedly over a period of time and at intervals sufficient to achieve a strengthening training effect. When the hips have reached a level of greater strength, the resistance band is removed from attachment with the belt and a resistance band having a second, greater, level of resistance is attached to the belt. The hips are rotated repeatedly over a period of time and at intervals sufficient to achieve a strengthening training effect using the resistance band having the second, greater, level of resistance.

DETAILED DESCRIPTION OF A PREFERRED EMBODIMENT AND BEST MODE

Figure 1:
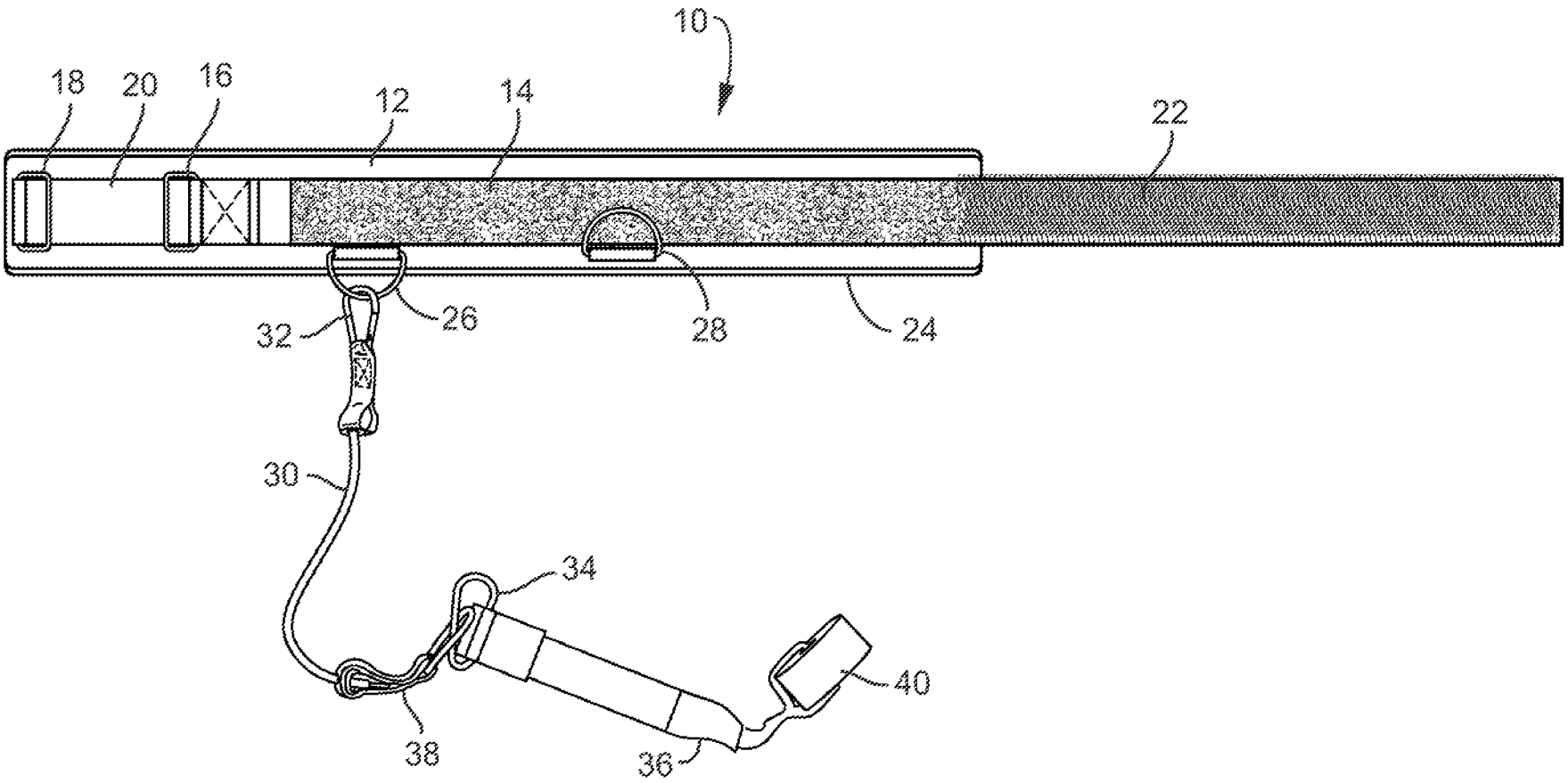
FIG. 1 is a plan view of the outer surface of an exercise and training apparatus according to one embodiment of the invention.

Referring now to the drawings, an exercise and training apparatus 10 for strengthening and training the hips and associated musculature is shown. The apparatus 10 is formed of a length of heavy webbing forming a belt 12. Loop material 14 is sewn or otherwise attached to the surface of the belt 12 along at least some of the length of the webbing on outer surface, as shown. Rings 16, 18 are sewn to the belt 12 with another length of webbing 20.

Figure 2:
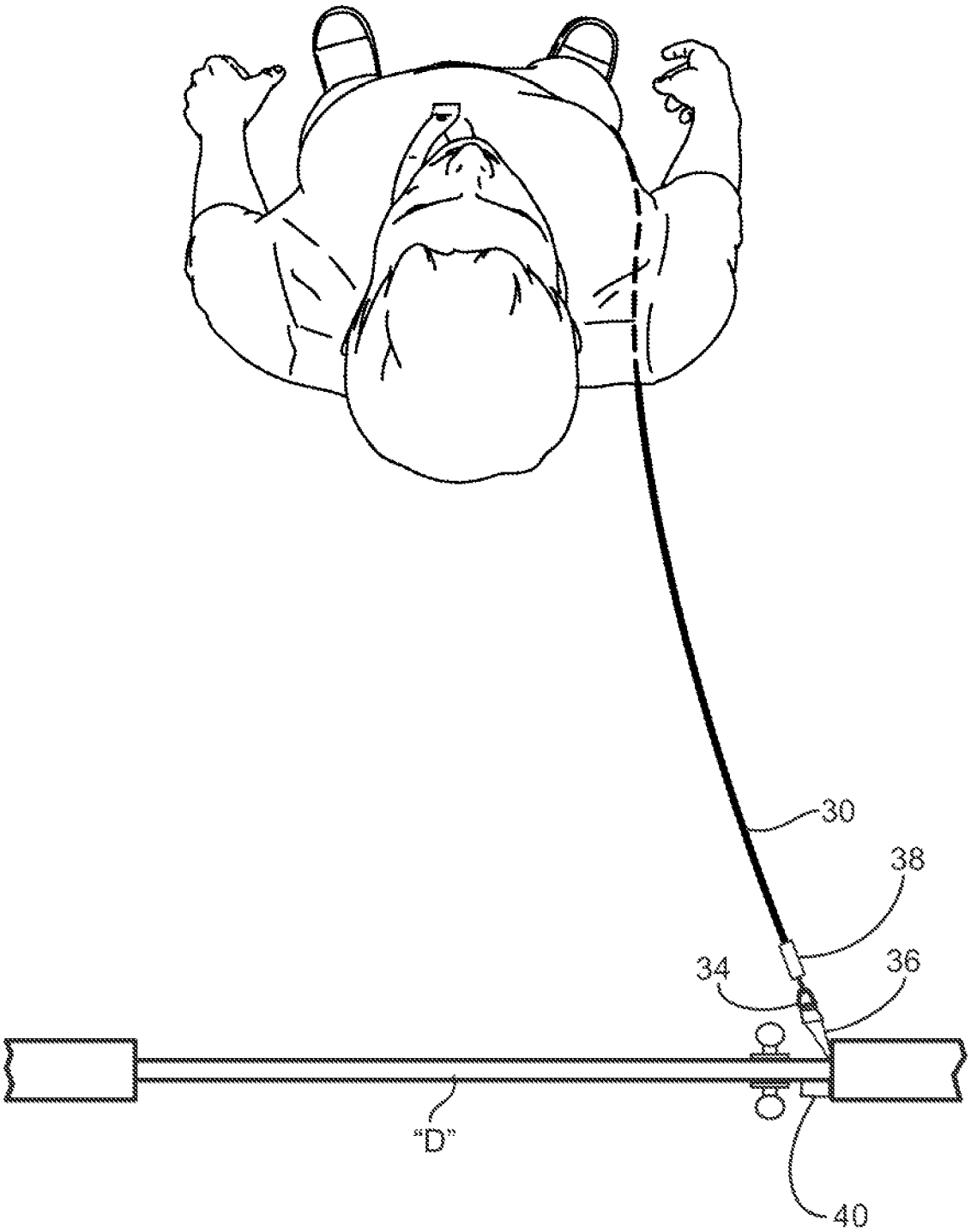
FIG. 2 is a top view looking down on a user wearing the exercise and training apparatus while at rest.

On the other end of the belt 12 the loop material 14 extends beyond the end of the belt 12. A length of complementary hook material 22 is attached to the free end of the loop material 14. By passing the end of the hook material 22 through one of the rings 16 or 18 and then doubling back the hook material 22 onto the loop material 14, the hooks and loops interlock and the apparatus 10 can be secured around the hips of the user. See FIG. 2. A layer of neoprene or some other suitable high-friction material 24 is applied to the inner surface of the belt 12 to increase "grab" with the apparel worn by the user to prevent the apparatus 10 from rotating around the hip during use.

Referring back to FIG. 1, a pair of D-rings 26, 28 are sewn onto the belt 12 in a central position symmetrical with respective ends of the belt 12. A resistance band 30 is provided and is attached to one or the other of the D-rings 26, 28 for use. The resistance band 30 may preferably be an elastic band such as a length of surgical tubing having a predetermined resistance to elongation. Resistance may be obtained by another means, including springs, solid or tubular rubber, plastic bands or other suitable resistance means.

The resistance band 30 has a carabiner 32 on one end permitting the resistance band 30 to be releasably attached to the belt 12 by locking into the D-ring 26, as shown in FIG. 1. According to one preferred embodiment of the invention, a carabiner 34 is attached to the other, distal end of the resistance band 30. A securing strap 36 formed of heavy-duty webbing also includes a carabiner 38 or another heavy-duty ring for attachment to the resistance band 30. The free, distal end of the securing strap 36 includes a large, heavy-duty foam anchor 40. By placing the anchor 40 on one side of a door and closing the door, trapping the anchor 40, the user can then stand away from the door to put initial resistance on the resistance band 30. The webbing of the securing strap 36 provides a robust anti-wear structure that will resist wear resulting from being tightly trapped between a door and door frame.

Figure 3:
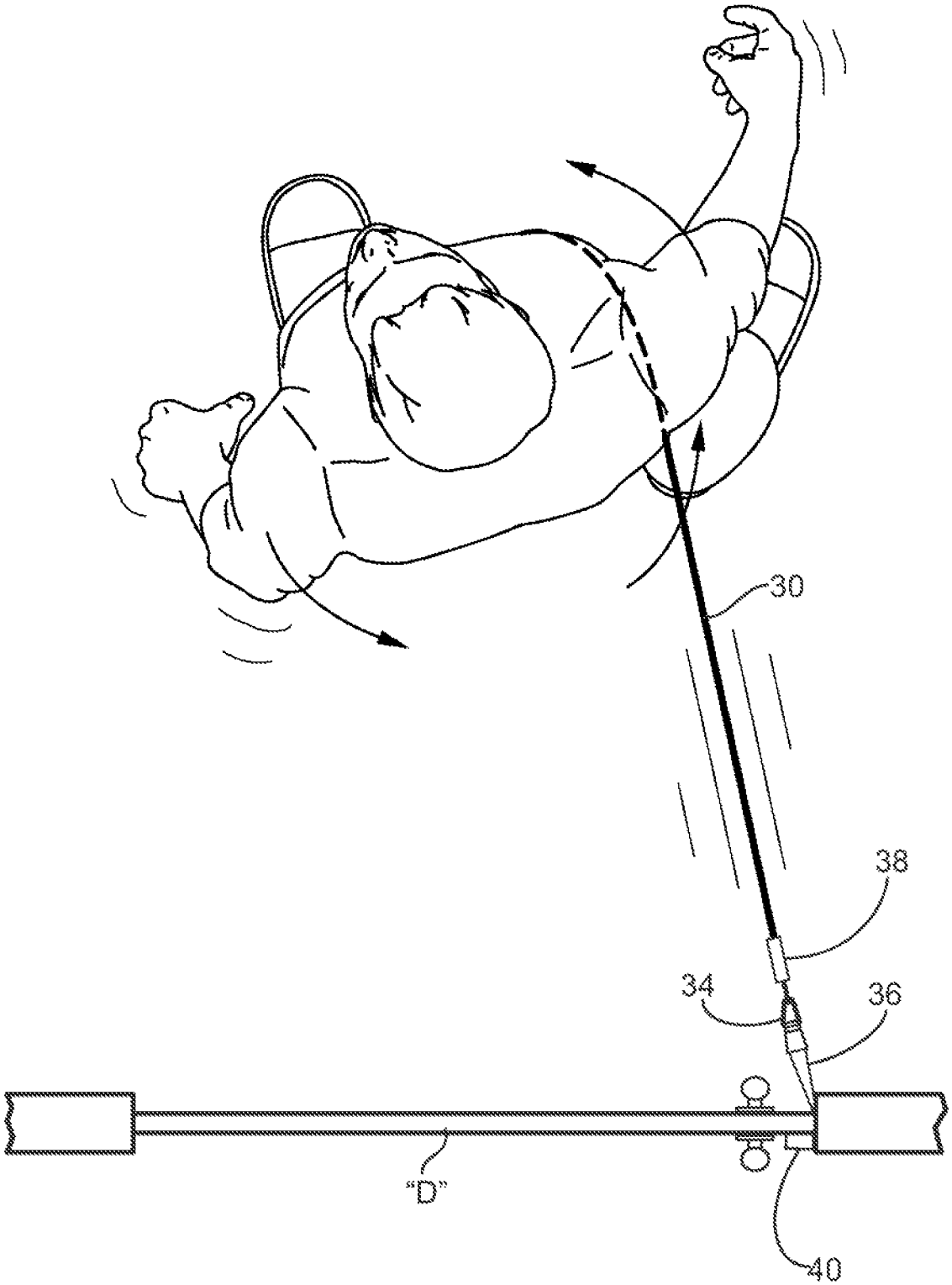
FIG. 3 is a top view looking down as the exercise and training apparatus is used in one direction of hip rotation.

By rotating the hip closest to the door away from the door, the hip and associated musculature is exercised as desired. See FIG. 3. An alternative, not shown, is to provide a resistance band 30 that has a length sufficient to allow the anchor 40 to be attached directly to a distal end of the resistance band 30 by, for example, the carabiner 38, instead of using the securing strap 36.

The apparatus 10 may be attached to any suitable support, although trapping the resistance band 30 between a door and door frame is ideal, since the range of adjustment is essentially infinite within the height of the door. This permits individuals of differing heights to easily adjust the height as needed. Maximum effectiveness will be achieved with the resistance band extending outwardly from the belt at the approximate height of the belt above floor level, since this position most closely corresponds to the pivoting motion of the hips of the user when swinging a golf club and thus provides training resistance optimized to achieve the desired training results.

Figure 4:
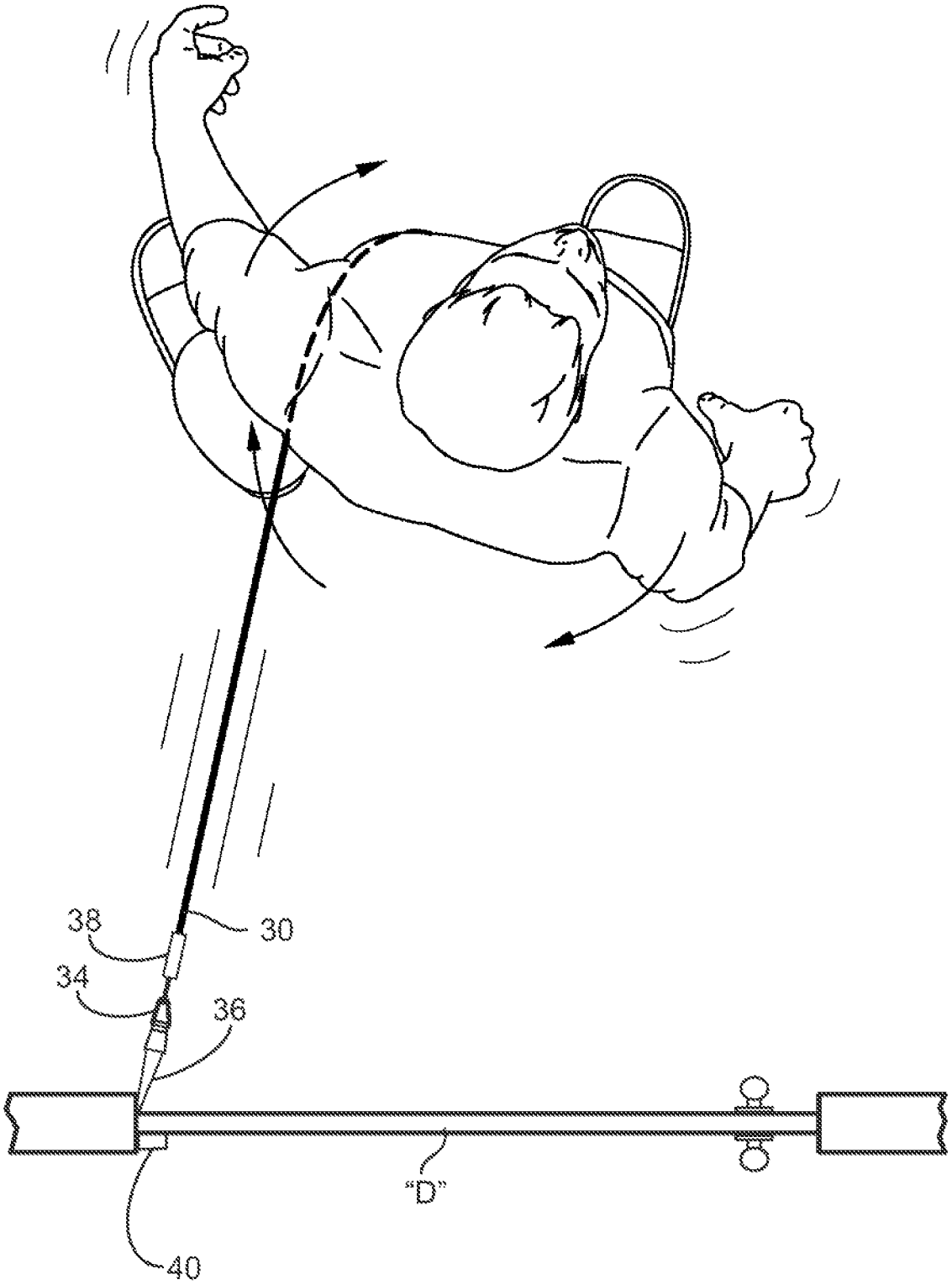
FIG. 4 is a top view looking down as the exercise and training apparatus is used in a direction of hip rotation opposite that shown in FIG. 3.
Figure 5:
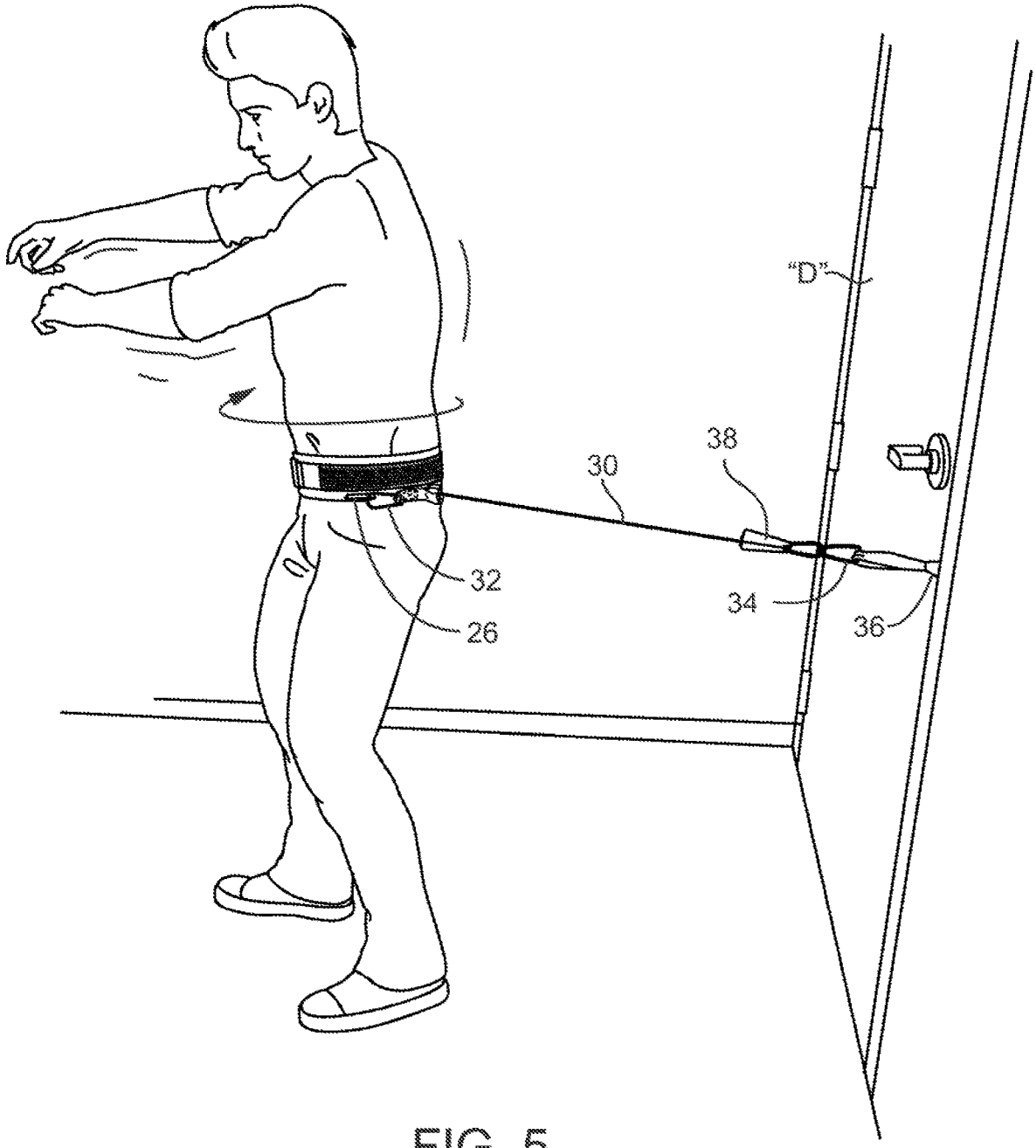
FIG. 5 is an environmental view showing the exercise and training apparatus in use.

To exercise the hip in the opposite direction, the carabiner 32 is opened, the resistance band 30 removed from the D-ring 26, moved to the D-ring 28 and attached in the same manner. See FIGS. 4 and 5.

Figure 6:
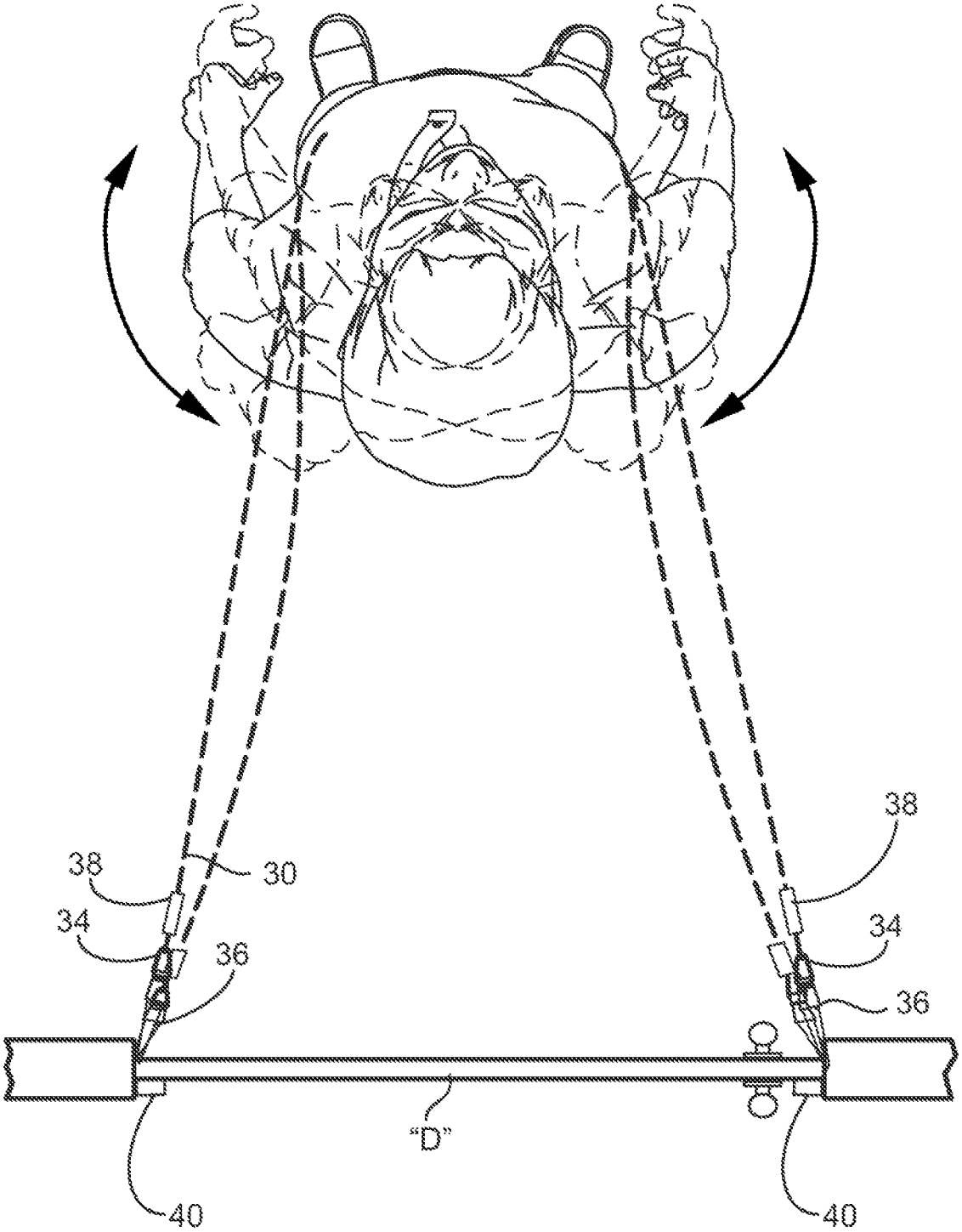
FIG. 6 is a top view looking down illustrated an alternative manner of use of the exercise and training apparatus.

As shown in FIG. 6, the apparatus 10 may be used by attaching two resistance bands 30 to the respective D-rings 26 and 28, and then pivoting left and right, either alternately for by pivoting in one direction for a set number of repeats and then in the opposite direction for a set number of repeats.

Figure 7:
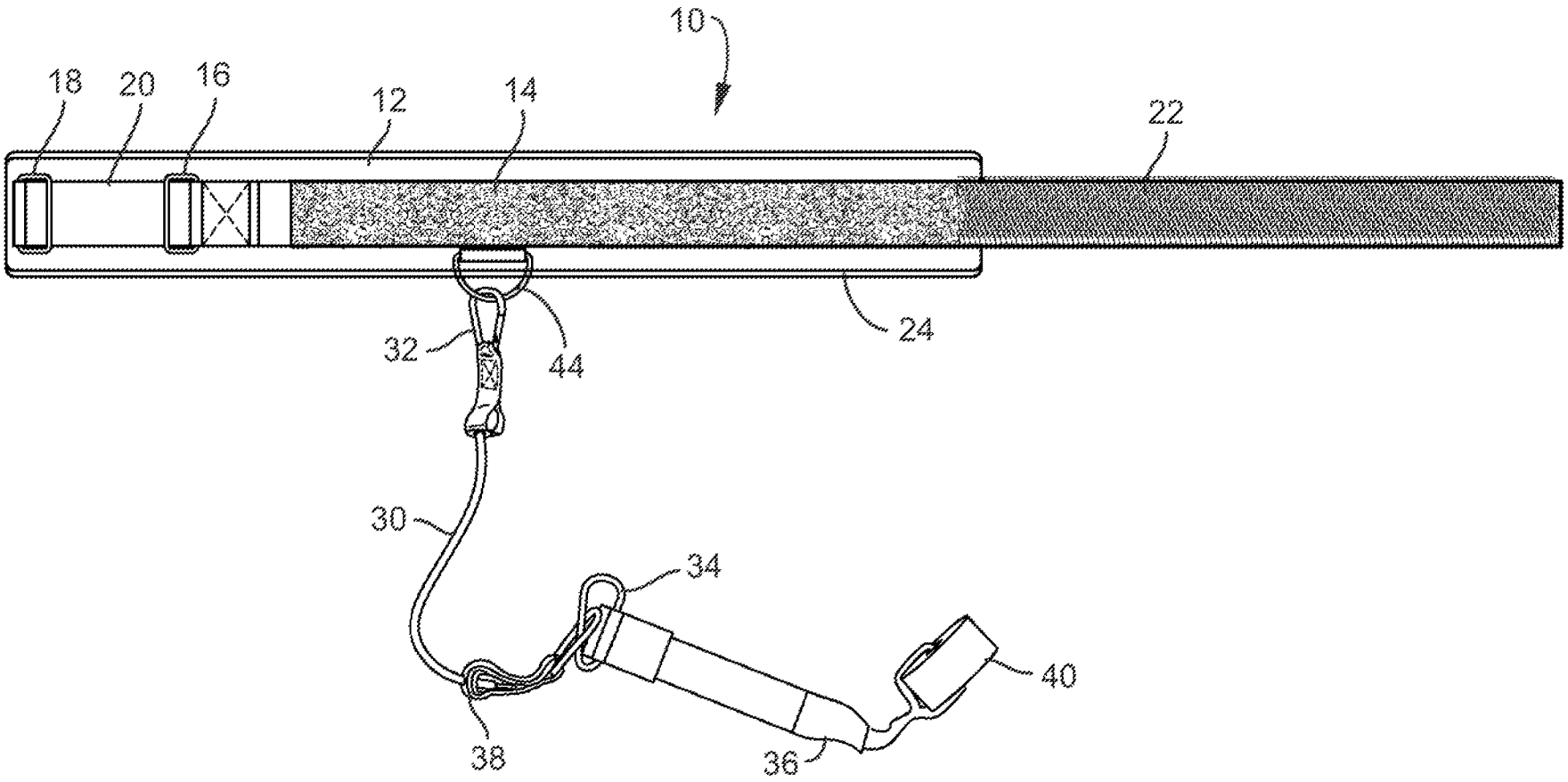
FIG. 7 is a plan view of the outer surface of an exercise and training apparatus according to an alternative embodiment of the invention.

Variations of the design elements described above can be made within the scope of the invention. For example, as shown in FIG. 7, a single D-ring 44 is attached to the belt 12 equidistant the opposing ends and permits the user to pivot in both directions without moving the belt 12 from one D-ring to another.

Attachment methods other than by use of touch fasteners, for example, a conventional leather, plastic or rubber belt with spaced apart holes adapted to receive the pin of a pin-type buckle, claw buckle, friction buckle and others may be suitable.

When training, resistance bands 30 with incrementally increasing levels of resistance may substituted as the exercise strengthens the hips. It has been found that 20 pounds (9 kilograms) may be a suitable weight at the commencement of a training program, with the weight increasing by 10 pound (4.5 kilogram) or 20 pound (9 kilogram) increments up to perhaps 100 pounds (45 kilograms) or greater by attaching multiple resistance bands.

An exercise apparatus for strengthening the hips according to the invention has been described with reference to specific embodiments and examples. Various details of the invention may be changed without departing from the scope of the invention. Furthermore, the foregoing description of the preferred embodiments of the invention and best mode for practicing the invention are provided for the purpose of illustration only and not for the purpose of limitation, the invention being defined by the claims.

We claim:

1. A method of strengthening the hips of a user, comprising the steps of:

providing:

a belt adapted for being tightly secured around a broad area of the hips and near a waist of the user, the belt comprising an inner surface that is proximate the user and an outer surface that is opposite the inner surface and distal to the user, the inner surface including a high-friction layer comprising a neoprene material configured to engage apparel worn by the user, the belt comprising a plurality of rings secured to the outer surface at different locations along a length of the belt, each ring of the plurality of rings being configured to receive a hook material that extends beyond the length of the belt and passes through at least one of the plurality of rings when the belt is secured around the broad areas of the hips and near the waist of the user;

a resistance band having a first predetermined level of resistance and adapted to be attached to the belt at a position wherein the resistance band resides proximate at the broad area of the hips and near the waist of the user;

a securing strap comprising webbing incorporating anti-wear structural properties configured to resist wear and adapted to be attached to a distal end of the resistance band and further comprising an anchor, wherein the anchor comprises a heavy-duty foam and is configured for being trapped, generally at a level with the broad area of the hips and near the waist of the user, on an opposite side of a closed door from the user;

securing the belt around the user's hips at a level with the broad area of the hips and near the waist of the user, the securing comprising passing at least a portion of the hook material through the at least one of the plurality of rings and doubling back the hook material to interlock with loop material attached to the outer surface of the belt;

trapping (i) the securing strap between the closed door and a door frame and (ii) the anchor on the opposite side of the closed door;

moving the belt to a position placing the resistance band under tension such that the resistance band is secured and positioned proximate a first hip side of the hips;

positioning both feet of the user so that toes of the feet of the user are facing in an opposite general direction from the closed door;

repeatedly performing a first hip rotation rotating the hips such that the first hip side rotates away from the closed door and towards the toes thereby elongating the resistance band;

repositioning the resistance band so that it is positioned proximate a second hip side opposite the first hip side, repeating the positioning of the feet, and repeatedly performing a second hip rotation rotating the hips such that the second hip side rotates away from the closed door and towards the toes thereby elongating the resistance band;

wherein the first hip rotation and the second hip rotation are performed repeatedly over a period of time and at intervals sufficient to achieve a strengthening training effect, and wherein the first hip rotation and the second hip rotation facilitate engaging the apparel worn by the user with the neoprene material;

when the hips have reached a level of greater strength, removing the resistance band from attachment with the belt;

attaching a resistance band having a second, greater, level of resistance to the belt and rotating the hips repeatedly over a period of time and at intervals sufficient to achieve a strengthening training effect using the resistance band having the second, greater, level of resistance.

2. The method of strengthening the hips of the user according to claim 1, wherein the high-friction layer is configured to engage the apparel worn by the user by removably adhering to the apparel.

3. The method of strengthening the hips of the user according to claim 1, wherein the high-friction material is configured to resist rotation of the belt relative to the broad area of the hips.

4. The method of strengthening the hips of the user according to claim 1, wherein the belt comprises a heavy webbing spanning from a first end to a second end, wherein the neoprene material spans the length of the heavy webbing.

* * * * *